United States Patent [19]

Dickson et al.

[11] Patent Number: 4,624,315

[45] Date of Patent: Nov. 25, 1986

[54] SUBSURFACE SAFETY VALVE WITH LOCK-OPEN SYSTEM

[75] Inventors: Rennie L. Dickson, Carrollton; Roddie R. Smith, The Colony, both of Tex.

[73] Assignee: Otis Engineering Corporation, Dallas, Tex.

[21] Appl. No.: 658,275

[22] Filed: Oct. 5, 1984

[51] Int. Cl.[4] ..... E21B 34/10

[52] U.S. Cl. ..... 166/323; 166/375

[58] Field of Search ..... 166/72, 323, 332, 375

[56] References Cited

U.S. PATENT DOCUMENTS

| | | | |
|---|---|---|---|
| 3,786,865 | 1/1974 | Tausch et al. | 166/323 |
| 3,786,866 | 1/1974 | Tausch et al. | 166/323 |
| 4,356,867 | 11/1982 | Carmody | 166/323 |
| 4,411,316 | 10/1983 | Carmody | 166/323 |
| 4,449,587 | 5/1984 | Rodenberger et al. | 166/323 |
| 4,475,599 | 10/1984 | Akkerman | 166/323 |

*Primary Examiner*—Stephen J. Novosad
*Assistant Examiner*—William P. Neuder
*Attorney, Agent, or Firm*—H. Mathews Garland

[57] ABSTRACT

A surface controlled subsurface well safety valve for use in a well tubing string including a flapper valve member, an operator tube for opening the flapper valve member and holding it open, an annular piston on the operator tube operative in response to control fluid pressure conducted from the surface, a spring biasing the operator tube to a position at which the flapper valve is closed, and a temporary lockout sleeve mounted in tandem with the flapper valve operator tube for movement simultaneously with the operator tube to a position at which the operator tube is inoperative and the temporary sleeve holds the flapper valve open, the operator tube and flapper valve having means for engagement of a lockout tool to operate the operator tube and lockout sleeve simultaneously. The lockout sleeve can be returned to inoperative position by control fluid pressure return of the operator tube to a position in which the tube holds the flapper valve open. The safety valve is operable with a single trip of a wireline device supporting the lockout tool. The lockout includes selective operating keys and a separate expandable latch ring for simultaneous coupling of the operator tube and the temporary lockout sleeve of the safety valve with the lockout tool.

19 Claims, 14 Drawing Figures

SUBSURFACE SAFETY VALVE WITH LOCK-OPEN SYSTEM

BACKGROUND OF THE INVENTION

This invention relates to surface controlled subsurface safety valves used in the oil and gas industry and particularly including mechanism for temporarily locking the valves open.

It is well known to complete oil and gas producing wells with systems including subsurface safety valves controlled from the surface to shut off the flow in the well tubing string. Generally such valves are controlled in response to a control fluid pressure conducted to the valve from a remote location at the surface end of the well permitting the wells to be selectively shut in as well conditions require. The surface controller may be equipped to respond to emergency conditions such as fire, broken lines, and the like. Frequently it is necessary to conduct well servicing operations through such a valve and when such a valve malfunctions it may be necessary to install a second safety valve. In any such events, it may be desirable to either permanently or temporarily lock the valve open. For example if the well servicing operation require extending a wireline or similar equipment through the subsurface safety valve it is preferable to use a lock open system which is not dependent upon a control fluid pressure from the surface. Where operations are being carried out through an open subsurface safety valve such as pressure and temperature testing it can be extremely expensive and time consuming for a valve to malfunction closing on the supporting wireline causing damage to the wireline and sensing apparatus supported from the wireline along with additional well servicing procedures required to retrieve the equipment. Subsurface safety valve including both permanent and a temporary lock open mechanism are shown in the following U.S. Pat. Nos. 3,786,865; 3,882,935; 4,344,602; 4,356,867; and 4,449,587. The present invention particularly relates to a subsurface safety valve of the type shown in U.S. Pat. Nos. 3,786,865 and 4,449,587 employing temporary lockout arrangements for the flapper type of valve included in the subsurface safety valves.

SUMMARY OF THE INVENTION

The present invention relates to a tubing-retrievable flapper-type safety valve having a housing connectable with a well tubing string and having a bore therethrough for well fluids flow into the tubing string, a flapper valve mounted in the housing for movement between a first closed position and a second open position, an operator tube in the housing bore moveable between a first position allowing the flapper valve to close and a second position holding the flapper valve open, a control fluid chamber and piston assembly between the housing and the operator tube for moving the operator tube from the first to the second position in response to fluid pressure on the piston, a spring coupled between the operator tube and the housing for moving the operator tube from the second back to the first position, and a temporary lockout sleeve mounted in the housing bore in tandem with the operator tube for movement between the first position of disengagement from the flapper valve and a second position engaging and holding the flapper valve open when the operator tube is at the first position, the operator tube and the lockout sleeve being configured for simultaneous coupling with a temporary lockout tool for shifting the operator tube and the temporary lockout sleeve to move the operator tube to the first position and the lockout sleeve to the second position at which the flapper valve is held open by the lockout sleeve. A temporary lockout tool is also provided having spaced selective locating keys and a latch ring for releasably coupling with the temporary lockout sleeve and the operator tube, respectively, and a releasable latch assembly for restraining the latch ring and latch keys at latching positions and releasing the latch ring and latch keys for disengagement of the temporary lockout tool from the operator tube and temporary lockout sleeve.

It is a principle object of the present invention to provide a subsurface safety valve for use in oil and gas wells including a temporary lockout device for holding the safety valve open during well servicing operations.

It is another object of the invention to provide a subsurface safety valve having an operating tube and a temporary lockout sleeve with a temporary lockout tool latching the operating tube and sleeve together during movement of the sleeve to a position in which the sleeve holds the flapper valve of the subsurface safety valve open.

It is another object of the invention to provide an improved subsurface safety valve having a temporary lockout sleeve wherein the operating tube and the lockout sleeve are coupled together and move simultaneously thereby avoiding malfunction due to separation of the sleeve and operating tube as the sleeve is moved to a position to hold the flapper valve open.

It is another object of the invention to provide a subsurface safety valve having a temporary lockout sleeve wherein malfunctionings of structure of the prior art such as springs, latches, and the like are minimized in a simplified design.

It is another object of the invention to provide a subsurface safety valve including a temporary lockout sleeve wherein the lockout sleeve is connected and moves simultaneously with the operator tube to provide continuous protection to the flapper valve and the lockout sleeve moves within the flapper valve seat protecting the seat and the flapper valve from debris in the bore of the safety valve during well operations.

It is another object of the invention to provide a subsurface safety valve including a temporary lockout sleeve wherein the power spring for the valve operator tube assists in shifting the temporary lockout sleeve to the flapper valve open position.

It is another object of the invention to provide a subsurface safety valve having a temporary lockout sleeve wherein only a single wireline trip is necessary to actuate the temporary lockout device.

It is another object of the invention to provide a subsurface safety valve having a temporary lockout sleeve which eliminates the need for a separate hold-open tool.

It is another object of the invention to provide a subsurface safety valve having a temporary lockout sleeve wherein the well operator may apply a control line pressure to test the control line connections as the valve is run into a well.

It is another object of the invention to provide a subsurface safety valve having a temporary lockout sleeve which provides a positive indication of the proper setting of the temporary lockout tool in the sleeve before the control line pressure to the subsurface safety valve is bleed off.

It is another object of the invention to provide a subsurface safety valve including a temporary lockout sleeve wherein the full travel of the sleeve is obtained by checking the control line fluids return.

It is another object of the invention to provide a subsurface safety valve including a temporary lockout sleeve which is disengaged from the flapper valve and returned to an inoperative position by control line pressure without the necessity to make a second wireline trip into the well.

It is another object of the invention to provide a subsurface safety valve including a temporary lockout sleeve and a temporary lockout tool which may be operated to check the proper functioning and full travel of the operator tube of the valve.

It is another object of the invention to provide a subsurface safety valve including a temporary lockout sleeve and a temporary lockout tool which may be used to jar the operator tube of the valve to free the tube when jammed by sand and other well debris.

The above and other objects and features of the invention will be apparent to those skilled in the art from the following detailed description of the present invention taken in conjunction with the accompanying drawings in which a preferred embodiment of the device of the invention is shown.

DESCRIPTION OF THE PREFERRED EMBODIMENT

Figure 1:
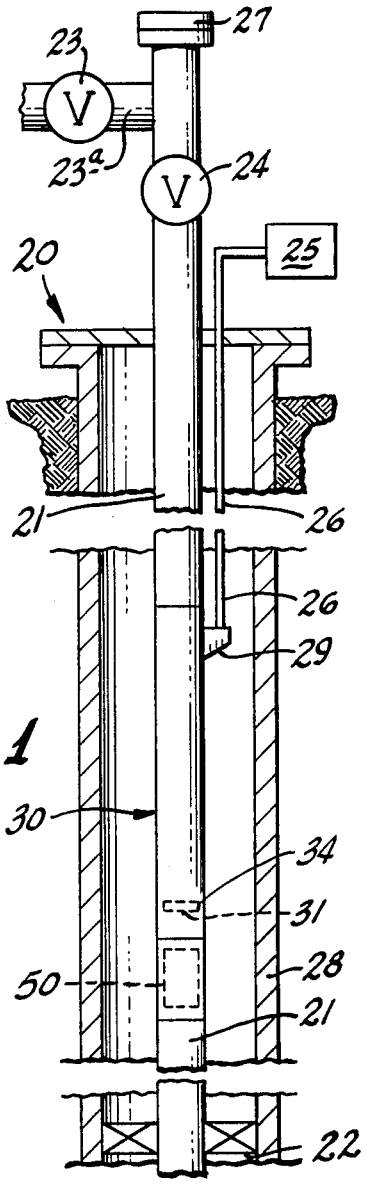
FIG. 1 is a schematic view in section and elevation of a typical well completion system including a tubing retrievable subsurface safety valve of the flapper-type of the present invention.

Referring to FIG. 1, a well completion system 20 includes a casing string 28 extending from the well surface to a hydrocarbon producing formation (not shown). A tubing string 21 extends from the well head within the casing string through a production packer 22 which seals between the tubing string and the casing directing formation fluids such as oil, gas, water, and the like into the tubing string from perforations (not shown) in the casing admitting the fluids from the formation to the well bore. Flow control valves 23 and 24 in the tubing string and in a lateral line **23*a* control fluid flow at the well head from the tubing string. A well head cap 27 is secured on the upper end of the tubing string to permit the string to be opened for servicing the well by wireline techniques which includes the installation and removal of various flow control devices such as valves from within the tubing string 21**. Other well servicing operations which may be carried out through the tubing string are bottom hole temperature and pressure surveys.

A surface controlled subsurface safety valve 30 embodying the features of the invention is installed in the well as a part of the tubing string 21 to control fluid flow to the surface in the tubing string 21 from a downhole location. The safety valve 30 is operated from the surface by control fluid conducted from a hydraulic manifold 25 at the surface to a fitting 29 which directs the fluid into the tubing string to the safety valve. The hydraulic manifold 25 may include pumps, a fluid reservior, accumulators, and control valves for the purpose of providing controlled pressure fluid flow to the safety valve for holding the valve open and allowing the valve to close when desired. Such a manifold 25 may also include apparatus which functions in response to temperature, surface line leaks, and the like evidencing emergency conditions under which the well should be shut-in.

The safety valve 30 includes a flapper-type valve member 31 mounted on a hinge 34 for swinging between a closed position schematically represented in FIG. 1 and an open position at which full flow is permitted upwardly in the tubing string 21. When a predetermined pressure is applied in the safety valve 30 through the line 26 from the surface the flapper valve member 31 is maintained at the open position. When the pressure is released the valve is allowed to close. In accordance with the invention a lockout sleeve 50 is provided in the valve 30 for movement from a first position at which the flapper valve member 31 is free to open and close and a second position at which the lockout sleeve holds the flapper valve member open. With the valve member restrained open by the lockout sleeve various well servicing operations may be carried out without fear of inadvertent closure of the valve which can be damaging to the servicing equipment. The lockout sleeve 50 is operated by wireline equipment and techniques manipulated in the tubing string from the surface through the cap end of the tubing string 21 after removal of the well cap 27. A wireline lockout tool for operating the temporary lockout sleeve 50 is illustrated in the drawings and described in detail hereinafter.

The details of the construction of the preferred form of the valve 30, the temporary lockout sleeve 50, and the lockout tool 51 used to operate the lockout sleeve are shown in FIGS. 2A–2E, inclusive. The subsurface safety valve 30 has a housing formed by a top sub 60, a bottom sub 61, and interconnected body joints 62, 63, 64, 65, and 66 which are suitably interconnected by threaded joints as illustrated. The housing has a central bore 67. The top and bottom subs 60 and 61 may be suitably internally threaded to provide connection at opposite ends of the valve housing into the tubing string 21 as represented in FIG. 1.

Figure 2A:
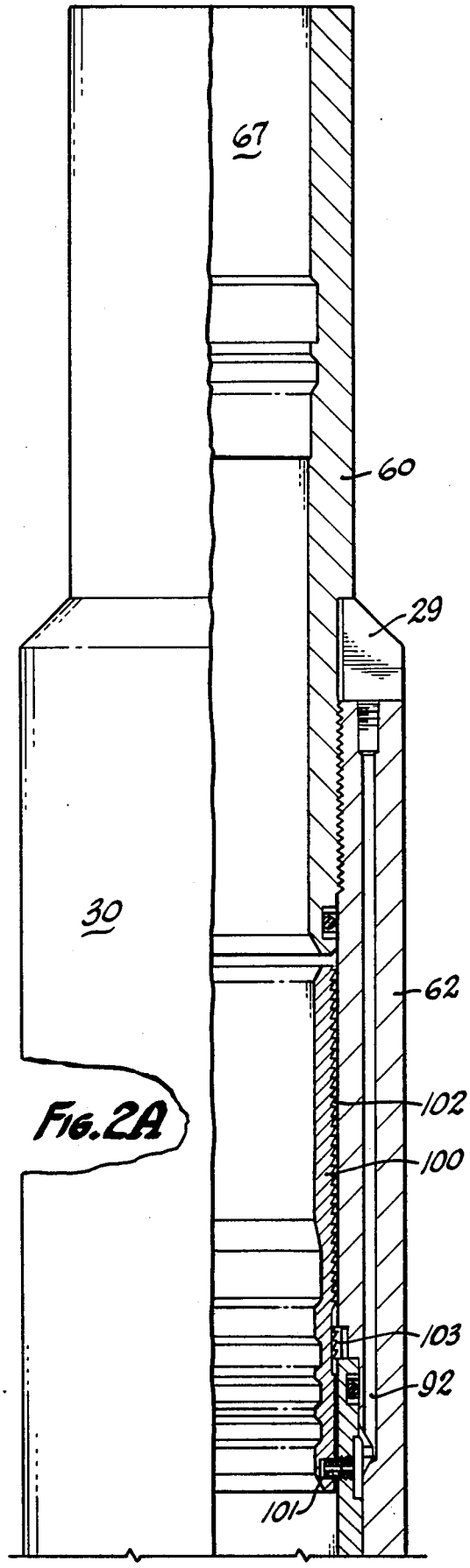
FIGS. 2A, 2B, 2C, 2D, and 2E taken together form a longitudinal view in section and elevation of the subsurface safety valve and temporary lockout tool of the invention showing the lockout tool landed and locked in the safety valve prior to shifting the lockout sleeve of the safety valve to the position for holding the flapper valve open.
Figure 2B:
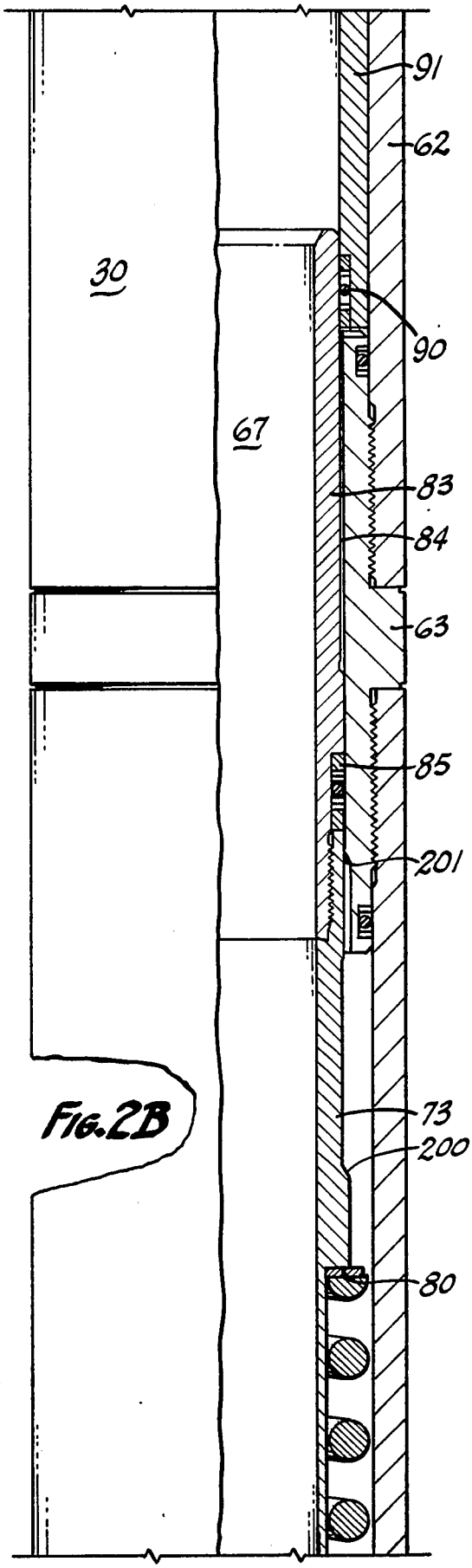
Figure 2C:
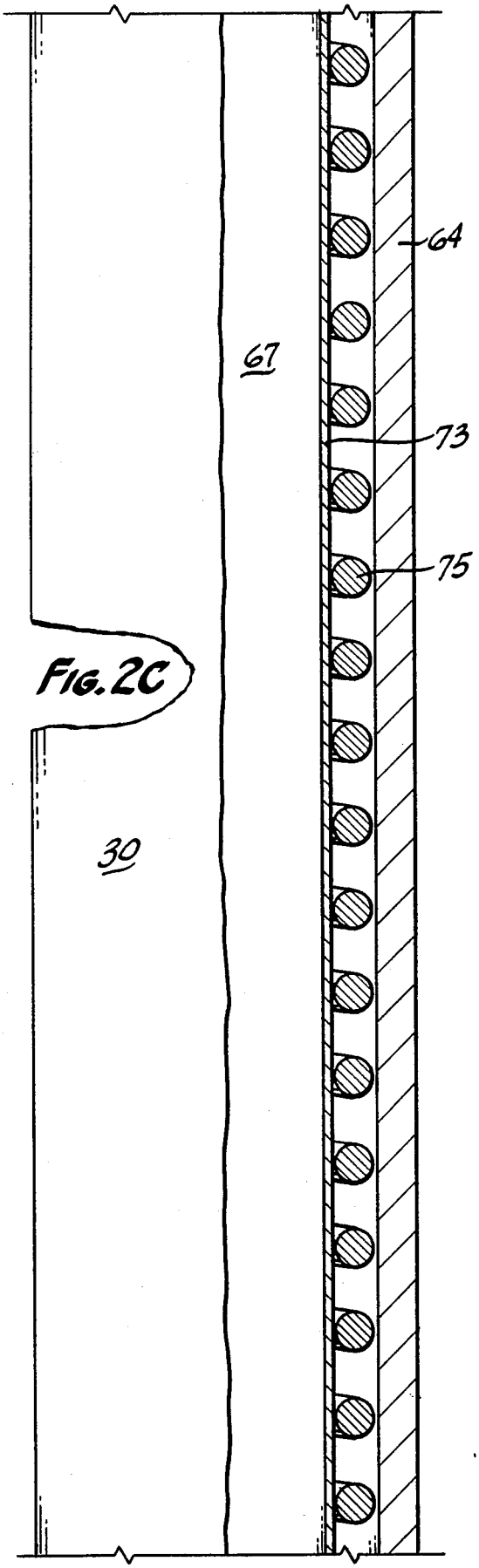
Figure 2D:
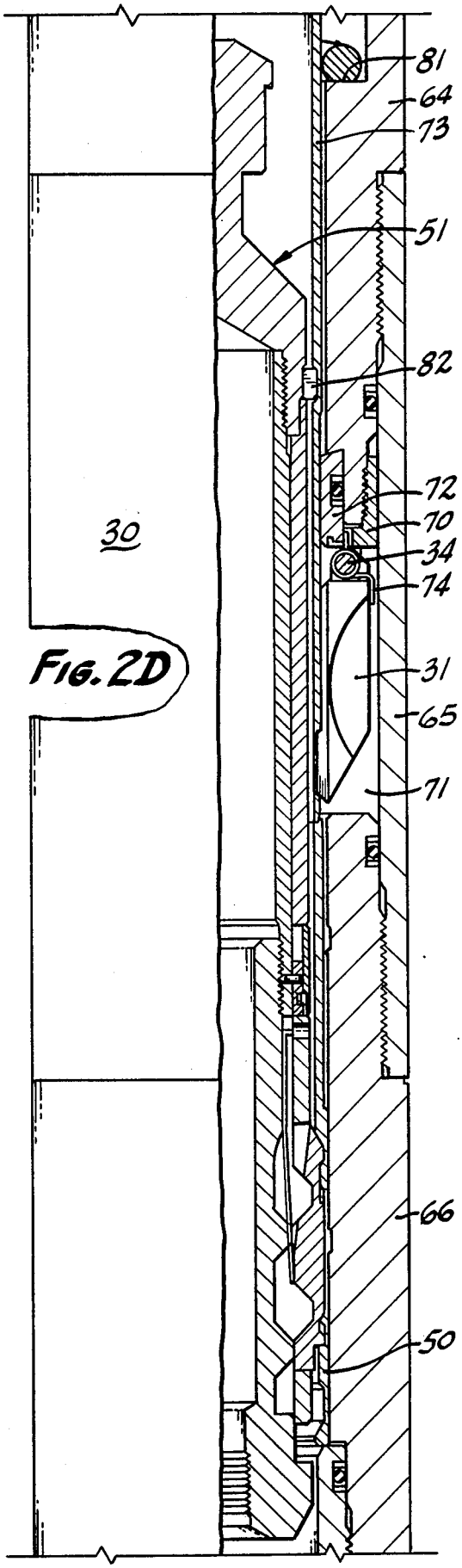
Figure 2E:
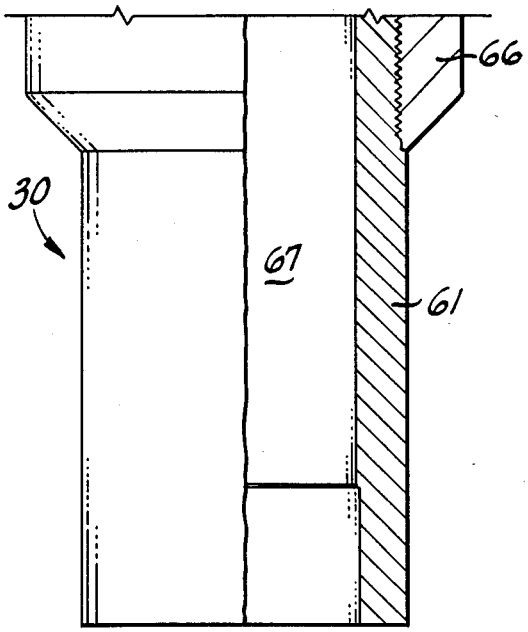

Referring to FIG. 2D the flapper valve member 31 is mounted on the hinge pin 34 and supported from a fitting 70 secured between the body joints 64 and 65. The flapper valve member swings to an open position in a pocket 71 defined between the lower end of the body of the housing joint 64 and the upper end of the housing joint 66 within the housing joint 65. The flapper valve member is engagable at the closed position shown in FIG. 1 with an annular seat 72 mounted in the lower end of the body joint 64. As seen in FIGS. 2B, 2C, and 2D, the flapper valve member 31 is operated by a longitudinal movable operator tube 73 as shown at a lower end position at which the flapper member 31 is held open in the pocket 71. The operator tube is biased upwardly toward an upper end position retracting the lower end of the tube above the flapper valve member sufficiently to permit the member to swing on the hinge pin 34 to a closed position. A spring 74 around the hinge pin 34 engaging the flapper valve member biases the valve member in a clockwise direction to move the valve member to the closed position when the operator tube is retracted upwardly. A coiled spring 75 around the operator tube 73 within the housing joints 63 and 64 is compressed between a stop shoulder 80 on the operator tube and a stop shoulder 81 within the housing joint 64 providing the upward biasing force on the operator tube. The lower end edge of the operator tube 73 engages the upper end edge of the temporary lockout sleeve 50 as seen in FIG. 2D limiting the downward movement of the operator tube. The operator tube has an internal annular latch recess 82 providing the means for engagement with the lockout tool 51 when the tool is used to shift the lockout sleeve.

Referring to FIGS. 2A and 2B, the operator sleeve 73 is connected to the lower end of an annular piston 83 slidable within the housing joint 63 the inner surface of which defines an annular control fluid cylinder 84 around the piston along a reduced diameter portion of the cylinder above an annular seal package 85 mounted on the piston. An upper end portion of the piston 83 slides within an annular seal package 90 in a sleeve 91 within the housing joint 62 above the upper end of the housing joint 63. The difference in the line of sealing engagement of the seal package 90 with the cylinder surface and the line of engagement of seal package 85 with the inner surface of the housing joint 63 provides an upwardly facing annular area on the piston acted upon by control fluid from the surface in the annular cylinder 84. The control fluid is communicated to the cylinder 84 along passage means within the housing joint 62 around the sleeve 91 from a flow passage 92 leading from the side fitting 29 which as shown in FIG. 1 communicates with the surface through the control fluid line 26. Fluid pressure on the piston within the annular cylinder 84 urges the operator tube 73 downwardly compressing the spring 75 moving the control tube downwardly to the lower end position for holding the flapper valve member 31 open in the pocket 71 as represented in FIG. 2D.

The safety valve 30 as seen in FIG. 2A is provided with a permanent lockout sleeve 100 which is releasably secured at an upper non-locking position by a shear pin 101 through the sleeve 91 into the lockout sleeve 100. The outside surface of the lockout sleeve 100 has a serrated finish 102 which is engagable with a similar finish within a lock ring 103 around the sleeve within the housing joint 62. The bore of the lockout sleeve 100 has an annular locking key recess profile defined by a plurality of longitudinally spaced recesses as seen in FIG. 2A for landing and locking a permanent lockout tool (not shown) in the event of malfunction of the flapper valve member 31. The permanent lockout sleeve 100 may be driven downwardly shearing the pin 101 to lock the operator tube 73 at a lower end position and a safety valve can then be landed in the top sub 60 if necessary. Unlike the temporary lockout sleeve 50, the permanent lockout sleeve 100 is not designed to return to the release position after it has been shifted downwardly to the lockout position.

Figure 5:
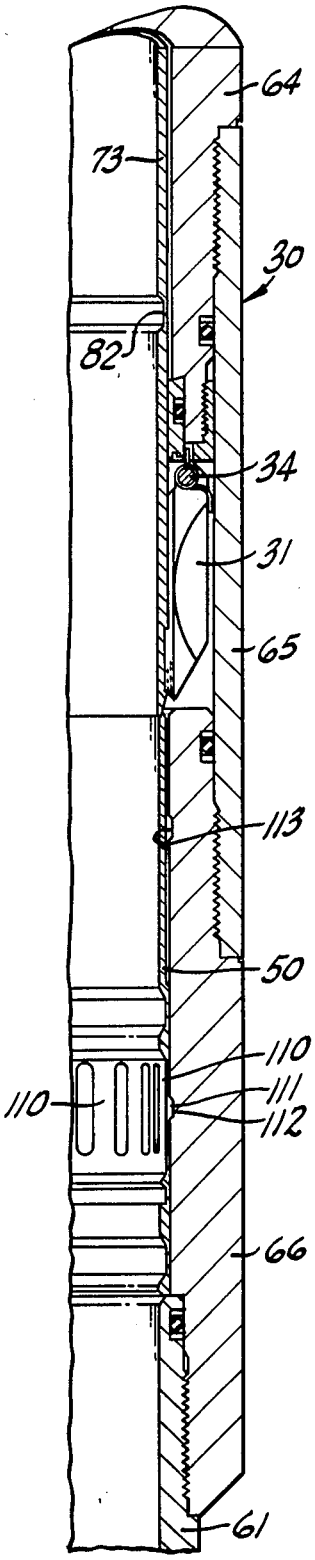
FIG. 5 is a fragmentary longitudinal view in quarter section showing the safety valve with the flapper valve open and the lockout sleeve of the safety valve at an inoperative position.
Figure 10:
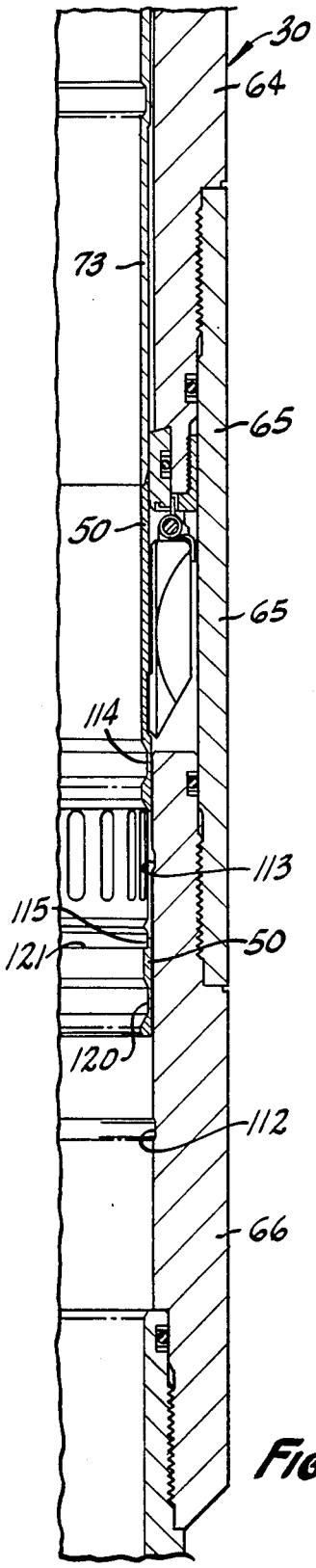
FIG. 10 is a view similar to FIG. 9 showing the temporary lockout tool fully removed from the safety valve leaving the flapper valve latched open by the temporary lockout sleeve.

Referring to FIGS. 2D, 5, and 10 the temporary lockout sleeve is releasably lockable at the lower end position shown in the FIGS. 2D and 5 at which the sleeve is below the flapper valve member 31 and the upper end position of FIG. 10 at which the sleeve extends above the open flapper valve holding the flapper valve in the pocket 71. A lower portion of the lockout sleeve is provided with longitudinal circumferentially spaced collet fingers 110 each of which has an external boss 111 engagable at the lower end position of FIG. 5 in an internal annually locking recess 112 of the housing joint 66 for releasably locking the lockout sleeve 50 at the lower inoperative position. The bosses 111 on the collet fingers of the lockout sleeve are engagable at the upper end position of the sleeve with an internal annular latch recess 113 within the housing joint 66 releasably locking the lockout sleeve at the upper end position at which the sleeve holds the flapper valve member 31 open. At the lower end position the lower end edge of the lockout sleeve 50 engages the upper end edge of the bottom sub 61. At the upper end position of the lockout sleeve 50, the upper end edge of the sleeve engages the lower end edge of the safety valve operator tube 73. The internal surface of the lockout sleeve 50 has longitudinally spaced internal annular latch recesses 114, 115, and 120 and a stop shoulder 121 defining a profile for engagement by selective operating keys on the lockout tool 51 as described hereinafter. The temporary lockout sleeve thus has an internal configuration which permits engagement by the lockout tool while simultaneously the tool also engages the operator tube 73 by means of the internal annular recess 82 in the sleeve.

Figure 3:
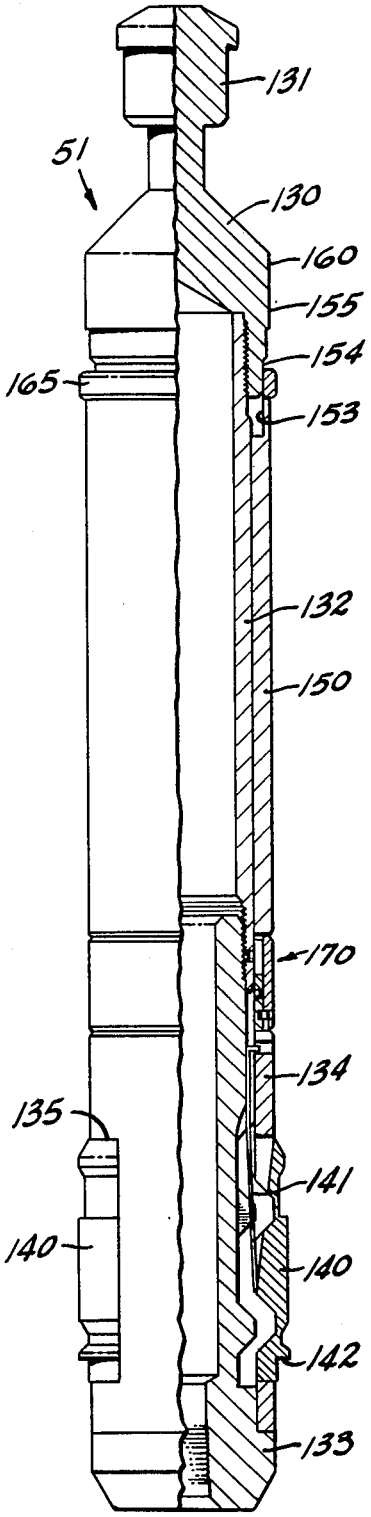
FIG. 3 is a longitudinal view in section and elevation of the lockout tool of the invention.
Figure 4:
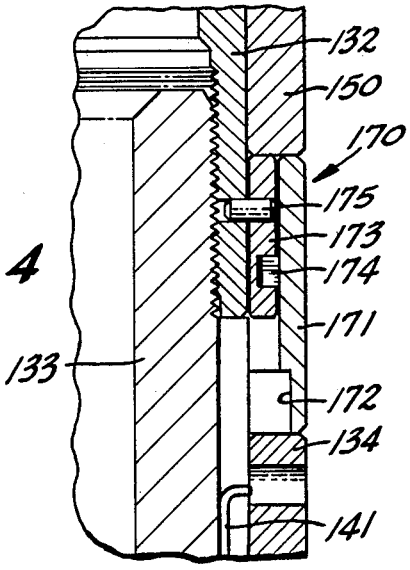
FIG. 4 is an enlarged fragmentary view in section of the latching device of the lockout tool.

The temporary lockout tool 51 which operates the temporary lockout sleeve 50 and the operator tube 73 of the safety valve 30, as seen in FIGS. 3 and 4, has a top sub 130 provided with a head 131 connectable with a wireline (not shown) for manipulating the tool in a tubing string such as the string 21. The top sub 130 is threaded on the upper end of a tubular housing member 132 which threads on a key mandrel 133. A key retainer sleeve 134 provided with a plurality of circumferentially spaced key windows 135 is mounted on the key mandrel 133. Selective operating keys 140 are held around the key mandrel within the windows 135 of the retainer sleeve 134. Each of the keys is biased outwardly by a spring 141. Each of the keys has an outer profile including a stop shoulder 142 shaped to engage the selective internal profile within the temporary lockout sleeve 50. The internal profile of the keys is substantially a mirror image of the outer profile of the key mandrel 133 so that at one position of the keys on the mandrel the keys are free to move inwardly to retracted positions while at a second position of the mandrel within the keys the keys are locked outwardly at locking positions such as within the temporary lockout sleeve 50. The tool 51 has an outer housing member 150 mounted to slide on the inner housing member 132. The upper end of the housing member 150 has an enlarged bore at 153 to permit the lower end of the top sub 130 to telescope downwardly into bore portion 153. The top sub 130 has a graduated outer diameter providing a first lower small section 154, a larger intermediate section 155, and a full diameter portion 160. A split lock ring 165 is mounted on the graduated portion of the top sub 130 above the upper end edge of the outer housing member 150. The split ring 165 is movable between a retracted release position as shown in FIG. 3 and an expanded locking position as shown in FIG. 2D. In the retracted position the split ring 165 retains the tool in locking condition. The split ring 165 locks the tool 51 with the operating tube 73 of the safety valve 30. A latch ring assembly 170 on the tool 151 is mounted around the inner housing member 132 between the upper end of the key retainer sleeve 134 and lower end of the outer housing member 150 as seen in FIG. 3 and 4. Referring to FIG. 4, the assembly 170 includes an outer latch sleeve 171 having an internal latch recess 172, and an internal latch sleeve 173 which carries a latch ring 174 which is biased outwardly and engagable in the latch recess 172 during the operation of the tool 51. The inner latch sleeve 173 is releasably secured with a lower end portion of the inner housing sleeve 132 by a shear pin 175 which provides a release function when the tool 51 is to be removed from the safety valve 30. The top sub 130, the inner housing sleeve 132, and the key mandrel 133 of the tool 51 move longitudinally as a unit relative to the outer sleeve 150, the latch ring 165, the key retainer aleeve 134, the latch ring 171, and the keys 140 as the tool 51 is shifted between the running mode, the latch and operating mode in the safety valve, and the release mode. The latch ring assembly 170 serves latching and releasing functions during these several modes of operation for temporarily locking the flapper valve member of the safety valve open.

OPERATION

Figure 6:
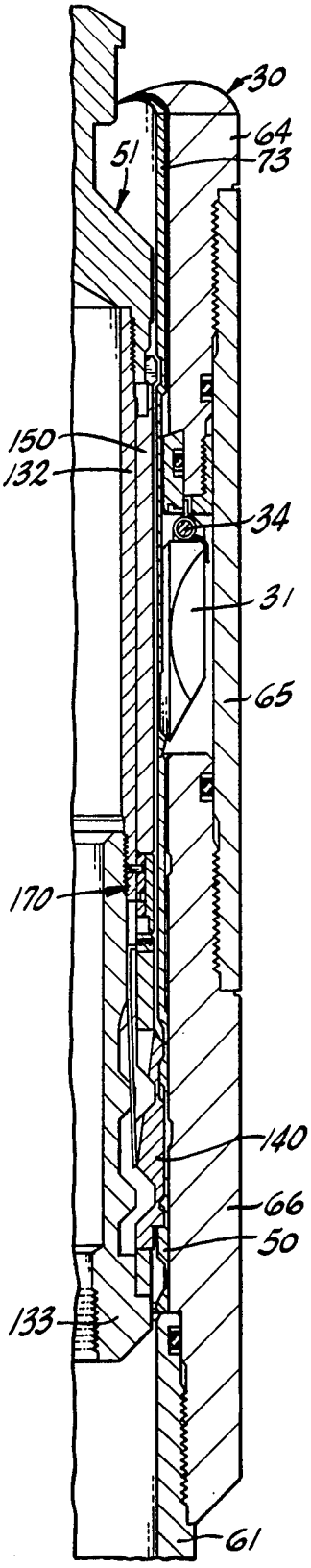
FIG. 6 is a view similar to FIG. 5 showing the initial step of landing the lockout tool in the safety valve for shifting the valve operator tube and lookout sleeve.
Figure 7:
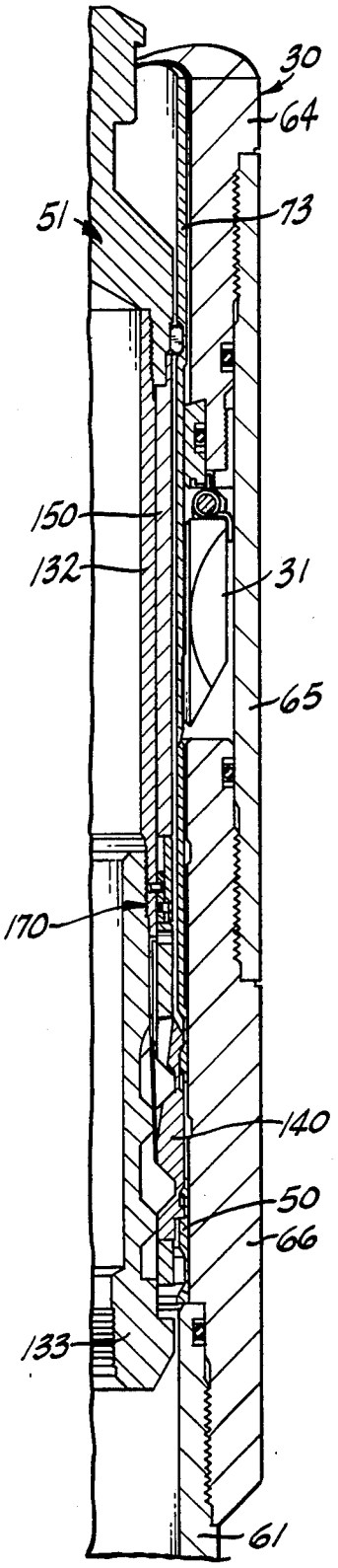
FIG. 7 is a view similar to FIG. 6 showing the lockout tool shifted to releasably lock the selective keys and latch ring of the tool with the lockout sleeve and operator tube of the safety valve.

For purposes of describing the operation of the devices of the invention, it shall be assumed that a well has been completed as previously described and illustrated in FIG. 1 and a control fluid pressure has been applied from the hydraulic manifold 25 through the control fluid line 26 into the side fitting 29 on the housing of the safety valve 30. The control fluid flows downwardly between the housing inner sleeve 91 and the housing joint 61 into the annular control fluid chamber 84 where the fluid pressure acts on an annular area of the piston 83 defined by the annular seal packages 85 and 90. The downward force of the control fluid pressure on the piston acts against the spring 75 compressing the spring as the operator tube 73 is forced downwardly swinging the flapper valve member 31 from the closed position of FIG. 1 to the open position illustrated in FIGS. 2D and 5–10. The flapper valve member is now in the pocket 71 between the housing joint 65 and the lower end portion of the operator tube 73. The lower end edge of the operator tube engages the upper end edge of the temporary lockout sleeve 50. The lockout sleeve 50 is at the lower end position at which the lower end edge of the lockout sleeve engages the upper end edge of the bottom sub 61 and the bosses 111 on the lockout sleeve collet fingers 110 are engaged in the latch recess 112 in the housing joint 66. Thus the operator tube 73 is engaged with the temporary lockout sleeve which is releasably latched at the lower end position by the collet fingers 110. The open condition of the safety valve 30 during normal flow of the well through the tubing string 21 is illustrated in FIG. 5. When temporary lockout of the flapper valve member is desired such as when running pressure and temperature tests and other well servicing operations, the first step in the sequence of operation is introduction of the temporary tool 51 into the tubing string 21 after the cap 27 has been removed from the upper end of the tubing string while the flapper valve member is held open by control fluid pressure. The lockout tool 51 is connected at the head 131 with a wireline (not shown) which is then supported from suitable standard wireline apparatus and lowered through the cap end of the tubing string 21 passing through a pressure tight head so that well pressure may be retained in the tubing string 21 as the lockout tool is lowered. The lockout tool is lowered into the safety valve 30 which is being held open by the control fluid pressure as represented in FIG. 5. As the lockout tool is lowered the selective keys 140 on the tool are biased outwardly dragging along the inner wall of the tubing string and downwardly into the bore 67 of the safety valve until the keys 140 are aligned with the inner bore profile of the lockout sleeve 50 defined by the recesses 115 and 120 with the stop shoulder 121. Since the profile of the keys 140 is the mirror image of the inner profile of the temporary lockout sleeve, the stop shoulder 142 on the keys 140 engages the stop shoulder 121 within the temporary lockout sleeve and the keys 140 expand into the landing and locking profile of the temporary lockout sleeve as illustrated in FIG. 2D and 6. With the keys 140 engaged in the temporary lockout sleeve, the latch ring 165 on the lockout tool 51 is aligned with the latch recess 82 in the operator tube 73 of the safety valve 30. It will be noted that in this landing condition of the lockout tool 51 inner latch sleeve 173 of the latch ring 170 is in the position shown in the FIGS. 4 and 6 in which the head 130 with the inner housing sleeve 132 and the key mandrel 133 are free to move downwardly relative to the outer housing sleeve 150 with the selective latch keys 140. A downward jarring force is applied by standard wireline techniques to the head 131 of the lockout tool driving the top sub 130 with sleeve 132 and the key mandrel 133 downwardly which carries the shear pin 175 along with the latch sleeve 173 and the latch ring 174 downwardly until the latch ring 173 is at a lower end position within the latch sleeve 171 shown in FIGS. 2D and 7. The latch ring 174 expands into the latch recess 172 releasably locking the key mandrel 133 with the sleeve 132 and the top sub 130 of the lockout tool at lower end positions. The top sub 130 has moved downwardly aligning the locking surface 155 within the latch ring 165 which is now held outwardly in the locking position in the latch recess 82 of the operator tube 73 within the safety valve 30 thereby latching the lockout tool 51 with the safety valve operator tube. Simultaneously the key mandrel 33 has moved downwardly within the keys of 140 misaligning the outer profile of the key mandrel with the inner profile of the keys to the position in the keys shown in FIGS. 2D and 7. The ridges or lands on the key mandrel 133 thus engage the ridges or lands within the keys 140 locking the keys in the expanded positions and thus latching the lockout tool 51 with the temporary lockout sleeve 50. Engagement of the latch ring 174 in the recess 172 of the lockout tool holds the top sub 130, the sleeve 132 and the key mandrel 133 of the lockout tool in the downward position at which both the latch ring 165 and the keys 140 are supported outwardly at the locking positions within the operator tube and the temporary lockout sleeve of the safety valve.

Figure 8:
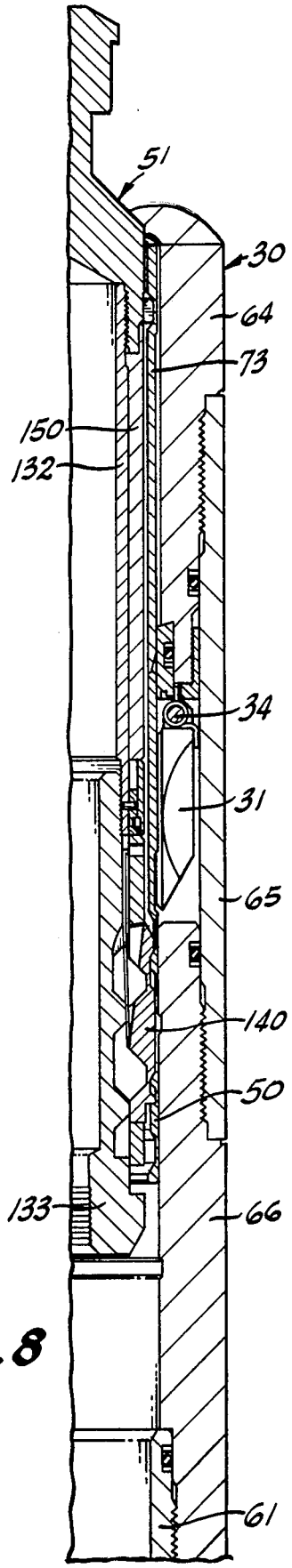
FIG. 8 is a view similar to FIG. 7 showing the temporary lockout tool and the operator tube and temporary lockout sleeve of the safety valve shifted to the position in which the lockout sleeve is holding the flapper valve of the safety valve open.
Figure 9:
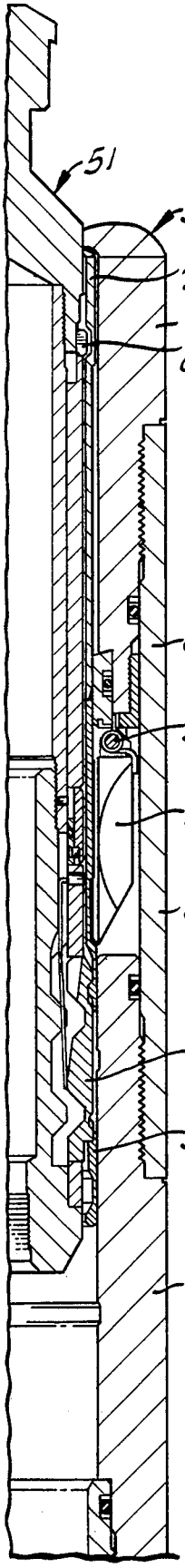
FIG. 9 is a view similar to FIG. 8 showing the temporary lockout tool shifted to a release position for removing the tool from the safety valve leaving the flapper valve latched open by the lockout sleeve.

The next step in the operation of the temporary lockout sleeve 50 of the safety valve 30 is the application of an upward force through the wireline to the lockout tool 51 to ensure that the tool has been located and locked in the safety valve operator tube and temporary lockout sleeve. This is accomplished while control fluid pressure is maintained in the safety valve to ensure that the operator tube 73 stays at the lower end position holding the flapper valve member 31 open. An application of a predetermined upward force by the well operator will indicate to the operator the proper setting of the lockout tool in the safety valve. The control fluid pressure holding the safety valve open is then bleed down by the hydraulic manifold 25 and an upward force is applied to the wireline to the temporary lockout tool head 131. A combination of the upward force on the wireline and the upward force of the spring 75 on the operator tube 73 of the safety valve simultaneously lifts the operator tube 73 and the temporary lockout sleeve 50 because the operator tube and the temporary lockout sleeve are latched together by the lockout tool 51. The operator tube 73 with the lockout sleeve 50 are lifted until the angled annular surface 200,FIG. 2B angled annular surface 201, FIG. 2B, on the operator tube engages the of the permanent lockout sleeve 100 limiting the upward travel of the operator tube and the temporary lockout sleeve. At this position of the operator tube 73 the temporary lockout sleeve is raised to the position shown in FIG. 9 at which the upper end of the temporary lockout sleeve is above the flapper valve member 31 and the flapper valve seat holding the flapper valve open. The latch bosses 111 on the collet fingers 110 of the temporary lockout sleeve are now engaged with the latch recess 113 in the housing joint 66 releasably latching the temporary lockout sleeve at the upper end position at which the sleeve retains the flapper valve member 31 open. These relative positions of the parts of the safety valve and the lockout tool are illustrated in FIG. 8.

The temporary lockout tool 51 is now removed from the safety valve to permit well servicing operations to be carried out through the safety valve which is being temporarily held open by the temporary lockout sleeve 50. An upward jar on the wireline to the temporary lockout tool applies an upward force to the head 131 transmitted downwardly through the inner housing sleeve 132 shearing the pin 175 releasing the upper mandrel 130, the sleeve 132, and the key mandrel 133 for movement back upwardly to the position shown in FIGS. 3 and 9 at which the latch ring 165 is aligned with the release surface 154 of the top of mandrel 130 of the lockout tool. The latch ring 165 is now free to move inwardly from the safety valve operator tube latch recess 82 and the key mandrel 33 is moved upwardly so that the outer profile of the key mandrel is aligned with the inner profile of the keys 140 so that the keys 140 are free to be compressed inwardly. Thus the lockout tool is released from the safety valve operator tube 73 and the temporary lockout sleeve 50 by both the latch ring 165 and the keys 140. The lockout tool is then pulled upwardly from the safety valve and removed from the tubing string 21 leaving the safety valve temporarily locked open as illustrated in FIG. 10 with the temporary lockout sleeve 50 at the upper end position. Prior to removal of the lockout tool from the safety valve the well operator may obtain a positive indication of the full upward movement of the operator tube 73 and the temporary lockout sleeve by measuring the quantity of the control fluid returned to the surface during the shifting of the temporary lockout sleeve from the lower end to the upper end operating position. Knowing the quantity of the control fluid displaced upwardly with the upward movement of the operator tube piston 83 provides a direct simple indication of the proper full movement of the temporary lockout sleeve. During the shifting operation by the lockout tool if the safety valve tends to malfunction due to the collection of debris around the moving parts of the valve such as along the operator tube 73 and within the mechanism of the flapper valve member 31, the fact that the lockout tool is latched with both the temporary lockout sleeve and the operator tube of the safety valve permits upward forces which tend to release the operating mechanism of the safety valve.

Once the well servicing and testing operations have been completed, it is not necessary to again run a wireline with the lockout tool or any other form of tool into the tubing string and safety valve. The safety valve may be returned to the normal operating condition by again applying control fluid pressure from the hydraulic manifold 25 through the line 26 to the safety valve. The control fluid pressure on the piston 83 of the safety valve forces the operator tube downwardly against the spring. The downward force on the operator tube is applied by the lower end of the operator tube to the upper end edge of the temporary lockout sleeve 50 which is forced back downwardly to the lower end position as shown in FIGS. 2D and 5 at which the temporary lockout sleeve is out of service and the lower end portion of the operator tube 73 again holds the flapper valve member 31 in the open position in the pocket 71. Thus the temporary lockout sleeve is rendered inoperative and the safety valve is placed back in normal service without the need for a second wireline trip into the well. Only the single wireline trip for actuating the temporary lockout sleeve is required. During the steps of placing the temporary lockout sleeve in operation and returning the safety valve to normal service the flapper valve member and supporting structure for the member are fully protected from any debris which may be in the flowing well fluids inasmuch as the operator tube of the safety valve and the temporary lockout sleeve function simultaneously in tandem engaged relationship thereby providing a protective cover for the flapper valve member and supporting structure during the several steps in the operation. Additionally the ability to apply direct force to the operator sleeve simultaneously with moving the temporary lockout sleeve permits correction of valve malfunction not possible with other similar valves in the prior art. Also, more surface information is available on the functioning of the safety valve operator tube and the temporary lockout sleeve than with similar prior valves.

What is claimed is:

1. A well safety valve comprising:

a housing having a bore therethrough;

a valve mounted in said housing to open and close to control the flow through said bore;

an operator tube in said housing for opening said valve;

means in said housing for moving said operator tube in a first direction to open and hold said valve open;

means in said housing for moving said operator tube in a second direction to permit said valve to close;

a temporary lockout sleeve in said housing in tandem with said operator tube for temporarily holding said valve open, said operator tube and said lockout sleeve being in end-to-end contact when said lockout sleeve is inoperative and said operator tube is holding said valve open, when said operator tube and said lockout sleeve are moving simultaneously in said housing between operating positions, and when said operator tube is inoperative and said lockout sleeve is holding said valve open; and said operator tube and said lockout sleeve each having means for coupling said operator tube and said lockout sleeve with a lockout tool for moving said operator tube and said lockout sleeve simultaneously when said lockout sleeve is moved from said inoperative to an operative position holding said valve open.

2. A well valve in accordance with claim 1 wherein said means for simultaneously coupling with said operator tube and said lockout sleeve comprises a latch engaging means on each of said operator tube and said lockout sleeve.

3. A well valve in accordance with claim 2 wherein said latch engaging means on each of said operator tube and said lockout sleeve comprises internal annularly recessed means.

4. A well valve in accordance with claim 3 in combination with a lockout tool having a first latch means for engaging said latch recess of said operator tube and a second latch means for engaging said latch recess means of said temporary lockout sleeve.

5. A well valve in accordance with claim 3 wherein said housing and said temporary lockout sleeve are provided with coengagable means for releasably locking said lockout sleeve at the said inoperative position and at said operative position.

6. A well valve in accordance with claim 4 wherein said co-engageable means comprises integral circumferentially spaced longitudinal collet fingers along said lockout sleeve, each finger having external bosses and spaced internal latch recesses along said housing for engagement by said bosses on said lockout sleeve collet fingers.

7. A well valve in accordance with claim 6 wherein said latch engaging means on said lockout sleeve comprises an internal profile for receiving selective operating keys on a lockout tool for operating said operator tube and said lockout sleeve.

8. A well valve in accordance with claim 2 in combination with a lockout tool for engaging and simultaneously moving said operator tool and said lockout sleeve said tube including a latch ring for engaging said latch recess in said operator tube and selective keys for engaging said selective profile in said lockout sleeve.

9. The combination of claim 8 wherein said lockout tool includes a top sub, an inner housing tube, and a key mandrel connected in tandem, an outer tube, a latch ring assembly and a key retainer sleeve connected together in tandem and slidable on said top sub, inner housing tube and key mandrel between latch and release positions, said latch ring being mounted on said top sub and expandable by relative motion between said top sub and said outer housing tube, and said keys being mounted in said key retainer sleeve and adapted to be locked in expanded positions by movement of said key mandrel within said keys.

10. The combination of claim 9 wherein said latch ring assembly latches the relatively moving parts of said lockout tool to hold said latch ring and said keys expanded and releases for contraction of said ring and said keys for removal of said lockout tool from said safety valve.

11. A well valve in accordance with claim 5 including a permanent lockout sleeve in said housing at the opposite end of said operator tube from said temporary lockout sleeve for movement to a position engaging and permanent holding said operator tube at a position for holding said valve open.

12. A well valve in accordance with claim 1 in combination with a lockout tool adapted for insertion into said housing bore and having means for simultaneously coupling with said operator tube and said temporary lockout sleeve for moving said operator tube and said temporary lockout sleeve between operating positions.

13. A surface controlled subsurface tubing supported well safety valve comprising in combination:

a tubular housing having a central bore therethrough and a means at opposite ends for connection of said housing in a well tubing string to form a section thereof;

a flapper valve hinged at one side thereof for movement between first position across said bore to shut off a flow through said bore and a second position at the one side of said bore to permit flow through said bore;

an operator tube movably supported concentrically within said bore of said housing for moving said flapper valve from said close position to said open position and holding said flapper valve open;

an annular piston means on said operator tube for moving said operator tube and holding said operator tube at said position for holding said flapper valve open;

said housing means in combination with said piston means defining a control fluid chamber around said piston means;

said housing means having passage means to said chamber for conducting control fluid to said chamber to operate said operator tube;

a fitting on said housing means to provide control fluid connection into said passage means;

a spring means between said operator tube and said housing means for biasing said operator tube in a direction toward a position at which said flapper valve is free to close;

a temporary lockout sleeve movably mounted in said housing means along the bore thereof on the opposite side of said flapper valve from said operator tube, said temporary lockout sleeve having an end edge engagable with an adjacent end edge of said operator tube when said operator tube and said temporary lockout sleeve are in different operating positions and while said operator tube and said temporary lockout sleeve are simultaneously moved between operating positions, said temporary lockout sleeve having latch means for releasably latching said sleeve at an inoperative position and at an operative position holding said flapper valve open;

means providing a latch recess within said operator sleeve;

means providing a latch recess in said temporary lockout sleeve;

said latch recesses in said operator sleeve and said temporary lockout sleeve permitting said operator sleeve and said temporary lockout sleeve to be releasably coupled together for simultaneously movement between operating positions.

14. A well valve in accordance with claim 13 wherein said latch means of said operator tube is an internal annular latch recess and said latch means of said temporary lockout sleeve comprises selective operating key recesses.

15. A well valve in accordance with claim 14 including a permanent lockout sleeve movably positioned in said housing bore at the opposite end of said operator tube from said temporary lockout sleeve for movement to a position in which said operator tube is permanently locked for holding said flapper valve open.

16. A well valve in accordance with claim 14 in combination with a lockout tool having an expandable latch ring for engaging said latch recess of said operator tube and selective expandable keys for engaging said selective key recesses of said temporary lockout sleeve.

17. A combination of claim 16 wherein said lockout tool includes a head member, an inner housing tube, and a tubular key mandrel connected together in tandem, an outer tube, a latch ring assembly, and a key retainer sleeve connected together in tandem on said head member, said inner tube, and said key mandrel for relative movement thereon, said latch ring is mounted on said head member for movement between release and locking positions, and said keys are mounted in said key retainer sleeve for radial movement responsive to the relative position of said key mandrel within said key retainer sleeve, said latch ring assembly releasably latching said lockout tool at locking and release positions of said latch ring and said keys.

18. A lockout tool for use in operating a temporary lockout sleeve of a well safety valve comprising:

a top sub adapted to be connected with a wireline;

an inner housing tube connected at a first end with said top sub;

a tubular key mandrel connected at one end with the second end of said inner housing tube, said key mandrel having a combination of external spaced recesses and bosses for cooperation with adjacent operating keys to expand and lock said keys and to permit said keys to contract inwardly;

said top sub being provided with a graduated outer surface having a latch ring release surface and a latch ring locking surface;

an expandable latch ring on said top sub moveable between said release and said latch surfaces;

an outer housing tube slidably mounted on said inner housing tube having an end extendable over said top sub for engaging and shifting said latch ring on said top sub between positions;

an annular latch ring assembly connected with an opposite end of said outer housing sleeve and releasably connectable with said inner housing tube;

a key sleeve having circumferentially space key windows mounted on said key mandrel connected with said latch ring assembly;

expandable and contractable keys mounted in said windows around said key mandrel having inside recesses and bosses cooperating with said recesses and bosses on said key mandrel for expanding and locking said keys and permitting said keys to move radially inwardly; and said latch ring assembly having a latch ring engagable with a latch recess to releasably lock said latch ring on said top sub and to hold said keys at expanded positions.

19. A lockout tool for use in operating a lockout sleeve of a well safety valve comprising:

means for attaching one end of the lockout tool to a wireline;

inner housing means slidably disposed within an outer housing means;

selective operating keys projecting radially through windows in the lockout tool;

key mandrel means attached to the inner housing means having one position allowing the selective keys to freely retract inward and a second position locking the selective keys radially outward;

a latch means on the lockout tool spaced longitudinally from the selective keys and expandable radially therefrom by movement of the housing means relative to each other;

means for releasably engaging the housing means to prevent relative movement therebetween; and the releasable means holding the inner housing means and key mandrel in the second position.

* * * * *